US007079789B2

(12) United States Patent
Wang

(10) Patent No.: US 7,079,789 B2
(45) Date of Patent: Jul. 18, 2006

(54) FUSER MECHANISM IN ELECTROPHOTOGRAPHIC APPARATUS

(75) Inventor: Zhong-Ming Wang, Liyang (CN)

(73) Assignee: BenQ Corporation, Taoyuan (TW)

( * ) Notice: Subject to any disclaimer, the term of this patent is extended or adjusted under 35 U.S.C. 154(b) by 0 days.

(21) Appl. No.: 11/018,129

(22) Filed: Dec. 21, 2004

(65) Prior Publication Data

US 2005/0135849 A1 Jun. 23, 2005

(30) Foreign Application Priority Data

Dec. 22, 2003 (TW) ..... 92136387 A

(51) Int. Cl.
*G03G 15/00* (2006.01)
*G03G 15/20* (2006.01)

(52) U.S. Cl. ..... 399/122; 399/328; 399/156; 399/67; 399/124

(58) Field of Classification Search ..... 399/328, 399/122, 67; 347/156
See application file for complete search history.

(56) References Cited

U.S. PATENT DOCUMENTS 5,164,570 A 11/1992 Okimura
6,135,023 A 10/2000 Sato
6,253,046 B1 * 6/2001 Horrall et al. ..... 399/124
6,733,944 B1 * 5/2004 Kadokura et al. ..... 430/124
2003/0210923 A1 * 11/2003 Pirwitz ..... 399/122
2005/0031376 A1 * 2/2005 Suzuki ..... 399/122
2006/0008294 A1 * 1/2006 Ito et al. ..... 399/122

FOREIGN PATENT DOCUMENTS

TW 188830 8/1992

* cited by examiner

*Primary Examiner*—Arthur T. Grimley
*Assistant Examiner*—Joseph S. Wong
(74) *Attorney, Agent, or Firm*—RatnerPrestia

(57) ABSTRACT

A fuser mechanism in an electrophotographic apparatus is disclosed. The fuser mechanism includes a first roller, a second roller, two elastic units, two adjusting devices, and a driving device. The first roller is rotatably and movably disposed in the electrophotographic apparatus. The second roller is rotatably disposed in the electrophotographic apparatus. The second roller is separated from the first roller with a gap for a paper passing through. Two elastic units are respectively disposed on two ends of the first roller to buffer movement of the first roller. The adjusting device is movably disposed between the first roller and the second roller. The drive device drives the adjusting device to push the first roller and adjust the gap.

16 Claims, 6 Drawing Sheets

FUSER MECHANISM IN ELECTROPHOTOGRAPHIC APPARATUS

CROSS REFERENCE TO RELATED APPLICATIONS

This application claims priority of Taiwan Patent Application Serial No. 092136387 entitled "Fuser Mechanism in Electrophotographic Apparatus", filed on Dec. 22, 2003.

1. Field of the Invention

The present invention relates to a fuser mechanism in an electrophotographic apparatus, particularly to an adjustable fuser mechanism in an electrophotographic apparatus.

2. Background of the Invention

The electrophotographic technique is used to create electrostatic image on photosensitive material. Common examples of electrophotographic apparatus are laser printer, fax, multi-function peripheral, copier, and the likes. For example, the laser printer distributes static electricity on a photoreceptor drum, and then uses laser beam to scan across the surface of the drum to discharge desired points. Thus, the laser creates aerial image to be printed as a pattern of electrical charges, namely an electrostatic image. After the pattern is set, the printer coats the drum with charged toner, such as carbon powder. The toner clings to the patterned areas of the drum. Finally, the toner is heated and melted to fuse with the fiber in the paper, and the image is then created.

Traditional thermal process utilized a pair of heated rollers, namely a fuser, to melt the toner.

FIG. 1 shows a traditional fuser having two rotatable rollers 12. The rollers 12 are separated by a gap 14 for a paper 16 passing through. At least one the rollers 12 is a heater to heat the paper to form the image.

However, the traditional fuser has some disadvantages. First, the gap 14 between two rollers 12 is unchangeable, while different papers may have different thickness. In this circumstance, the image quality may be unsatisfied due to inappropriate pressure and temperature in the fuser. Second, papers are easily jammed in the traditional fuser and even damage the apparatus. Although some modified fusers have been provided for the above problems, however, these solutions relies on complicated mechanism and requires a lot of units to complete the adjustment so that the raise the manufacturing and maintenance cost.

Therefore, it is required to provide fuser mechanism in an electrophotographic apparatus with the advantages of low cost, easy manufacturing, and high yield rate.

SUMMARY OF THE INVENTION

One aspect of the present invention provides an adjustable fuser mechanism in an electrophotographic apparatus to adjust gap in response to papers with different thickness.

Another aspect of the present invention provide a fuser mechanism in an electrophotographic apparatus with the advantage of low cost and easily manufacturing, in which the paper jam would not damage the fuser mechanism.

The fuser mechanism of the present invention includes a first roller, a second roller, two elastic units, two adjusting devices, and a driving device. The fuser mechanism is embodied in an electrophotographic apparatus. The electrophotographic apparatus includes an image formation unit and a housing. The housing accommodates the image formation unit and the fuser mechanism. The first roller is rotatably and movably disposed in the housing. The second roller is rotatably disposed in the housing. The second roller is separated from the first roller with a gap for a paper passing through. Two elastic units are respectively disposed on two ends of the first roller to buffer movement of the first roller. The adjusting device is movably disposed between the first roller and the second roller. The drive device drives the adjusting device to push the first roller and adjust the gap.

The first roller and the second roller respectively have a first bearing and a second bearing. The elastic unit includes a groove, a bearing pad, and a resilient unit. The groove guides movement of the first roller, and the resilient unit is coupled to the bearing pad to buffer movement of the first roller and provide a force to the first roller. The bearing pad touches the first bearing of the first roller. The adjusting device includes an engagement part and a contact part. The contact part touches the first bearing of the first roller. The driving device includes an axle and a gear. The axle is rotatably disposed inside the housing. The gear is disposed on the end of the axle and engaged with the engagement part of the adjusting device.

DETAILED DESCRIPTION OF THE INVENTION

Figure 1:
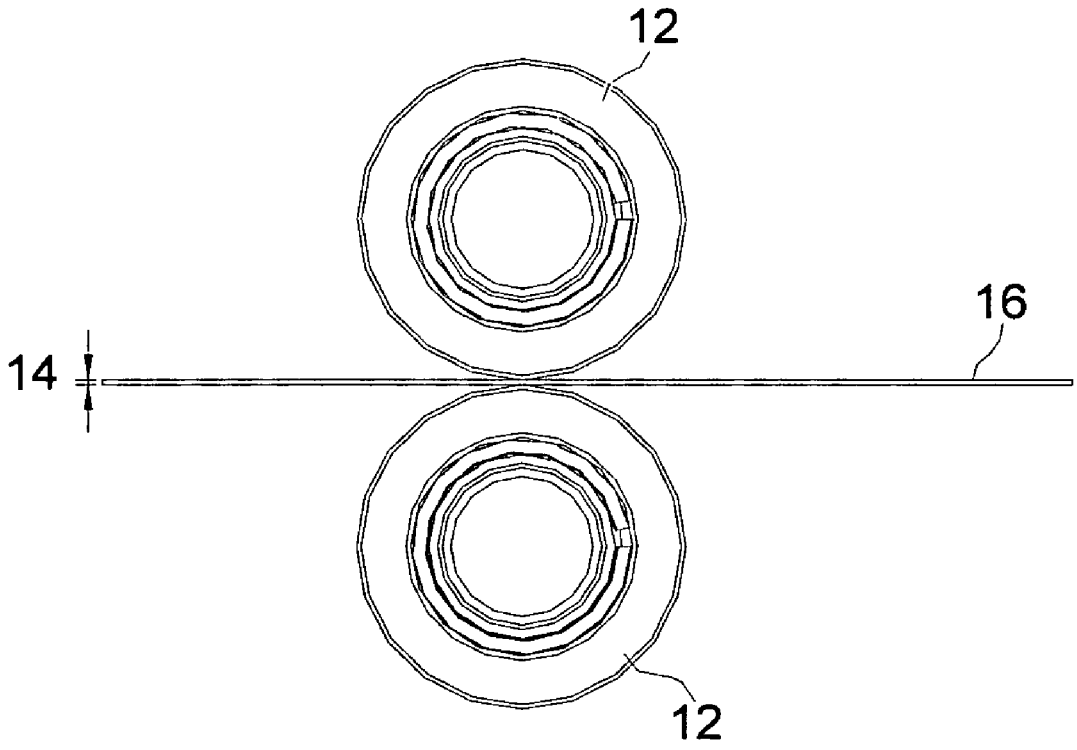
FIG. 1(Prior Art)
FIG. 1 is a schematic view of prior art fuser mechanism.
Figure 2A:
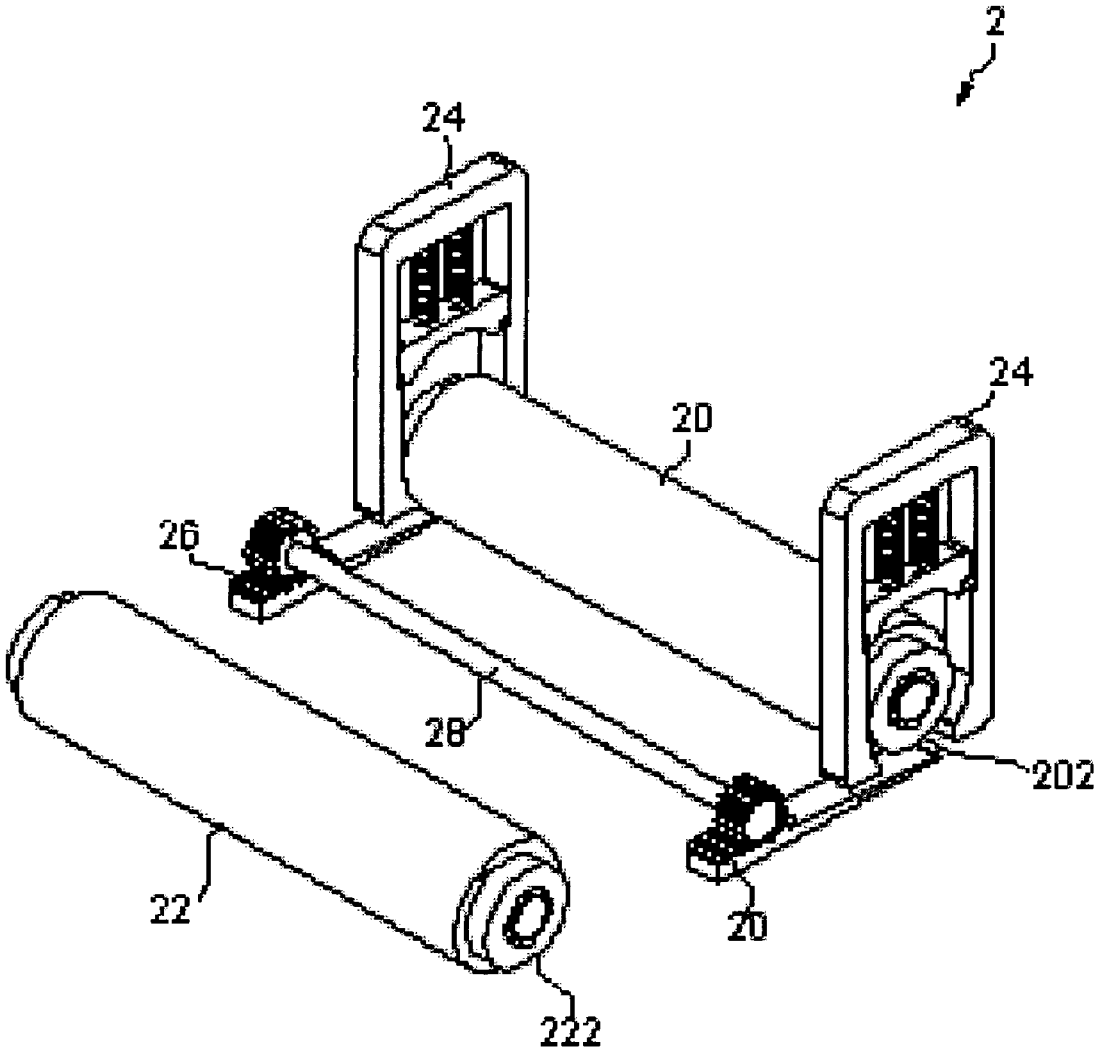
FIG. 2A is an explosive view of a fuser mechanism in accordance with the present invention.
Figure 2B:
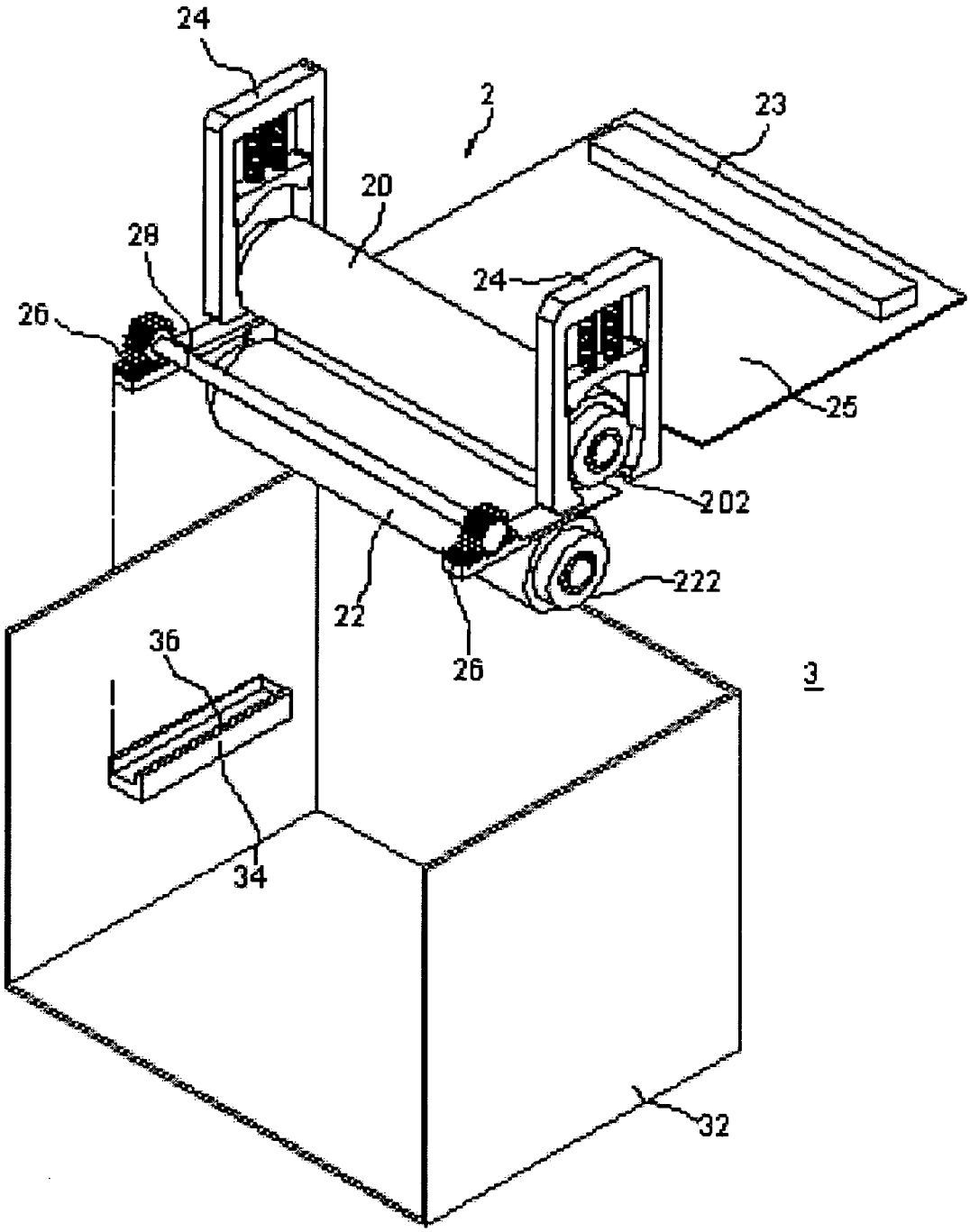
FIG. 2B is a schematic view of an electrophotographic apparatus in accordance with the present invention, wherein the fuser mechanism in FIG. 2A is embodied.

The present invention discloses a fuser mechanism in an electrophotographic apparatus. FIG. 2A is an explosive view of a fuser mechanism in accordance with the present invention. The fuser mechanism 2 includes a first roller 20, a second roller 22, two elastic unit 24, two adjusting device 26, and a driving device 28. FIG. 2B is a schematic view of an electrophotographic apparatus 3 in accordance with the present invention, wherein the fuser mechanism 2 shown in FIG. 2A is embodied. The electrophotographic apparatus 3 includes an image formation unit 23 and a housing 32. The image formation unit 23 provides the toner onto a paper 25 to form an image. The housing 32 accommodates the fuser mechanism 2 and the image formation unit 23. At least one of the first roller 20 and the second roller 22 has a heater to fuse the toner with the paper 25.

Referring to FIG. 2A and FIG. 2B, the first roller 20 is rotatably and movably disposed inside the housing 32. The second roller 22 is rotatably disposed inside the housing 32, and separated from the first roller 20 with a gap 30 for a paper 25 passing through. Two elastic units 24 are rotatably disposed on two ends of the first roller 20 serving as a buffer for the first roller 20. Two adjusting devices 26 are disposed between the first roller 20 and the second roller 22, and respectively located at two ends of the first roller 20. The housing 32 includes a pair of support arms 34 respectively supporting two adjusting device 26. Each support arm 34 includes a track 36 to guide movement of the adjusting device 26. Driving device 28 drives the adjusting device 26 to move, and thus forces the first roller 20 to move. The value of the gap 30 is therefore changed.

Figure 3:
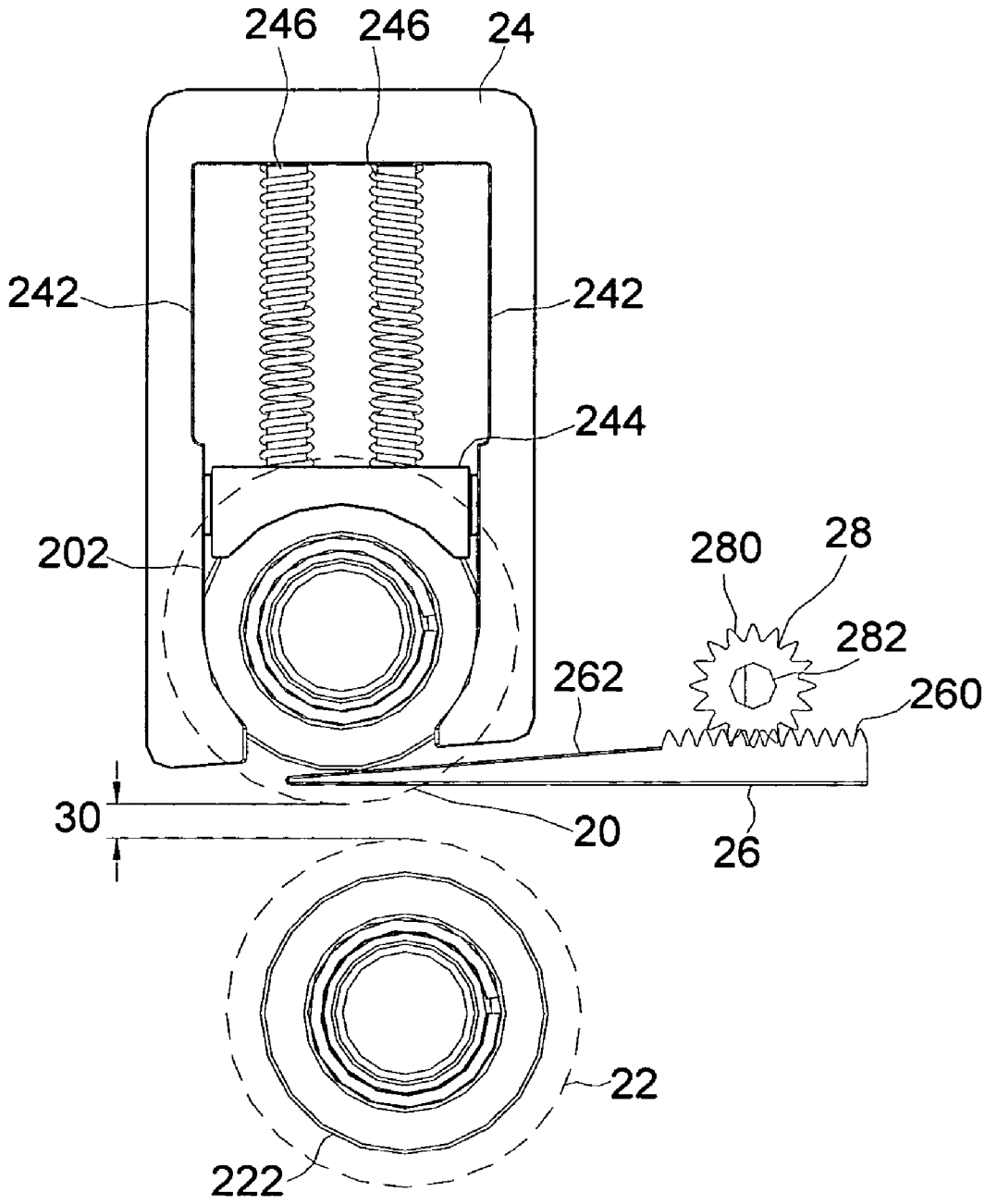
FIG. 3 is a side view of the fuser mechanism in FIG. 2A with the gap having normal value.

FIG. 3 is a side view of the fuser mechanism in FIG. 2A. The first roller 20 and the second roller 22 respectively have a first bearing 202 and a second bearing 222. The elastic unit 24 includes a groove 242, a bearing pad 244, and a resilient unit 246. The groove 242 guides movement of the first roller 20, and the resilient unit 246 is coupled to the bearing pad 244 to buffer movement of the first roller 20 and provide a force to the first roller 20. The bearing pad 244 touches the first bearing 202 of the first roller 20. The adjusting device 26 includes an engagement part 260 and a contact part 262, and the contact part 262 touches the first bearing 202 of the first roller 20. In this embodiment, the contact part 262 includes a sloping surface. However, various modifications may be made without departing from the scope of the present invention. For example, a plurality of surfaces forming a ladder-like shape. The driving device 28 includes an axle 282 and a gear 280. The axle 282 is rotatably disposed inside the housing 32. The gear 280 is disposed on the end of the axle 282 and engaged with the engagement part 260 of the adjusting device 26.

In FIG. 3, the gear 280 of the driving device 28 engages with the engagement part 260 of the adjusting device 26 at a first position, thereby the gap 30 between the first roller 20 and the second roller 22 is a first value, namely a normal value of the gap 30. The normal value of gap 30 is configured to allow the paper 25 with a default thickness to pass through the gap 30, wherein the paper 25 is exerted appropriate pressure and temperature from the fuser mechanism 2.

Figure 4:
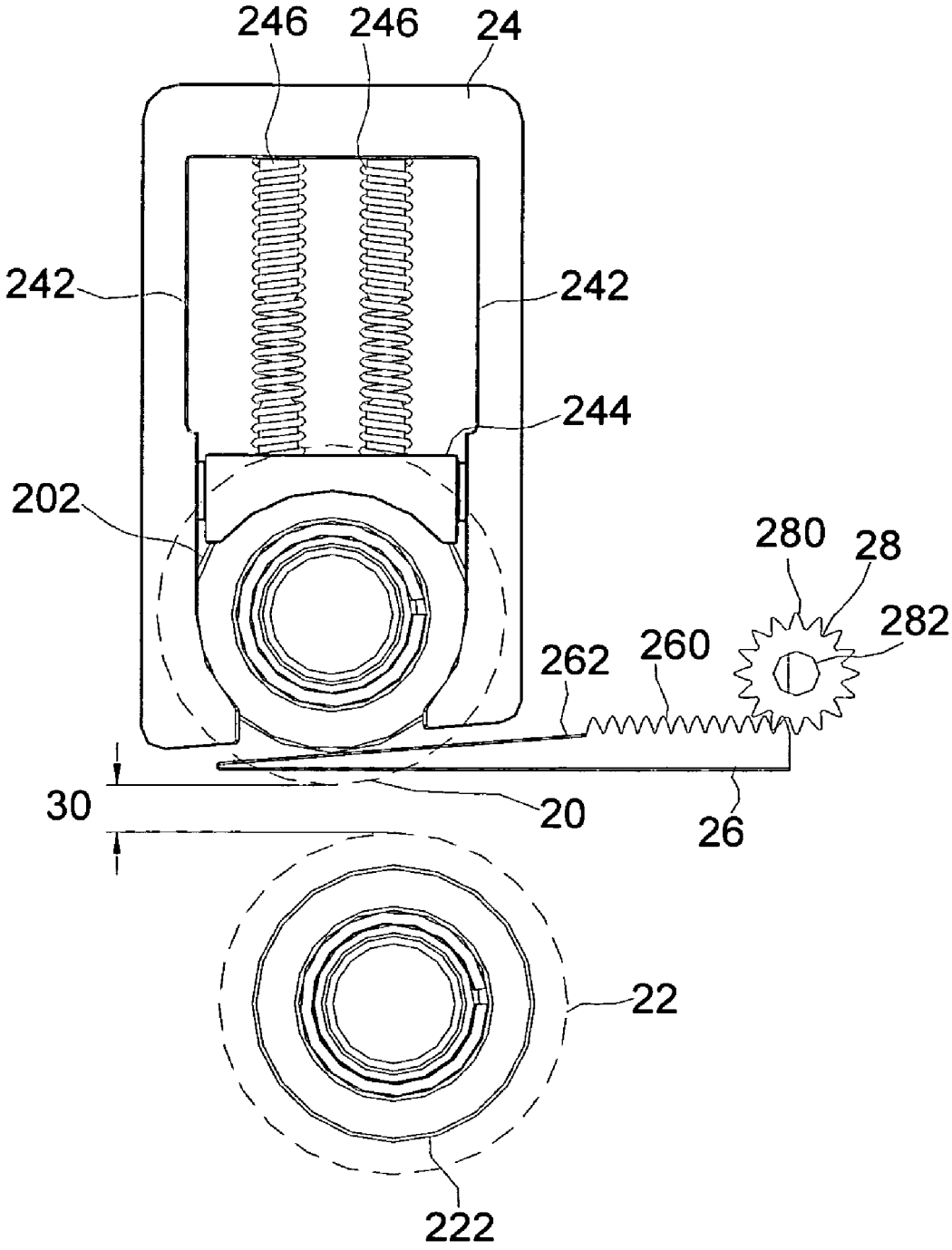
FIG. 4 is a side view of the fuser mechanism in FIG. 2A with the gap having maximum value.
Figure 5:
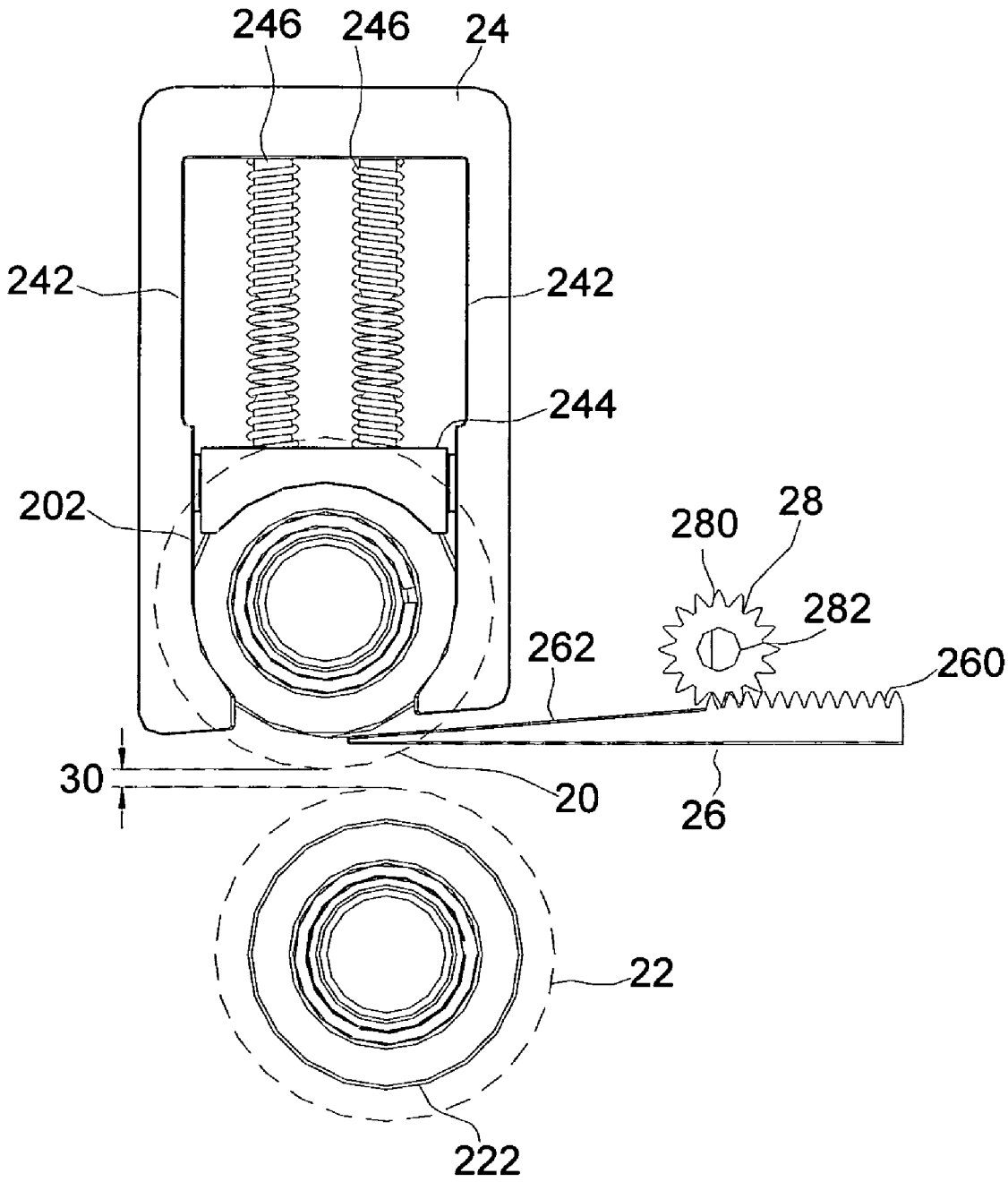
FIG. 5 is a side view of the fuser mechanism in FIG. 2A with the gap having minimum value.

It should be noted that those skilled in the art would understand that the driving device 28 may include a motor coupled to the axle 282, although it is not shown in the FIG. 3. The motor drives the axle 282 and gear the 280 to rotate clockwise or counterclockwise. In this embodiment, the engagement part 260 is a rack. When the axle 282 and the gear 280 rotate, the adjusting device 26 moves correspondingly through the interaction between the engagement part 260 and the gear 280. When the axle 282 and the gear 280 rotate clockwise, the contact part 262 of the adjusting device 26 pushes the first roller 20 to move along the groove 242, and the gap 30 is enlarged. FIG. 4 illustrates a maximum value of gap 30. When the axle 282 and the gear 280 rotate counterclockwise, the adjusting device 26 moves correspondingly and the resilient unit 246 pushes the first roller 20 to move along the groove 242, and the gap 30 is reduced. FIG. 5 illustrates a minimum value of gap 30.

It should be noted that there are three values of gap 30 indicated from FIG. 3 to FIG. 5 for illustration purpose. Those skilled in the art, however, should readily understand that the adjusting device 26 of the present invention might adjust the gap 30 in response to any different thickness of paper. The fuser mechanism 2 in accordance with the present invention provides better image even the paper has different thickness. Moreover, jammed paper can be easily removed without damage to the fuser mechanism 2 by enlarging the gap 30 of the adjusting device 26 of the present invention.

The above description sets forth various preferred embodiments of the invention only, and is not intended to limit the scope, applicability, or configuration of the invention in any way. Rather, various changes may be made in the function and arrangement of the elements described in these embodiments without departing from the spirit and scope of the invention. Thus, the protected scope of the present invention is as set forth in the appended claims.

What is claimed is:

1. A fuser mechanism for an electrophotographic apparatus including a housing, the fuser mechanism comprising:

a first roller, having a first bearing, rotatably and movably disposed inside the housing;

a second roller, having a second bearing rotatably disposed inside the housing and separated from the first roller with a gap for a paper passing through;

at least an elastic unit disposed on one end of the first roller to provide a force pushing the first roller toward the second roller along a first direction; and at least an adjusting device movably disposed on one side of the first roller, the adjusting device having a contact part located between the first bearing and the second bearing, the contact part having a sloping surface touching the first roller;

wherein as the adjusting device moves along a second direction substantially perpendicular to the first direction, the sloping surface touching against the first roller to provide a force pushing the first roller to move opposite to the first direction, which causes value of the gap to be changed.

2. The fuser mechanism of claim 1, further comprising a driving device, and wherein the adjusting device further includes an engagement part, the driving device comprising:

an axle rotatably disposed inside the housing; and at least a gear disposed on one end of the axle and engaging with the engagement part of adjusting device;

wherein engagement between the gear and the engagement part enables the driving device to drive the adjusting device to move during rotation of the axle.

3. The fuser mechanism of claim 2, wherein the driving device further comprises a motor coupled to one end of the axle for rotating the axle.

4. The fuser mechanism of claim 2, wherein the gear selectively rotates clockwise and counterclockwise.

5. The fuser mechanism of claim 1, wherein each of the elastic unit further comprises:

a U-shaped frame;

a groove disposed on the U-shaped frame for guiding the movement of the first roller;

a bearing pad for touching one side of the first roller; and a resilient unit coupled to the U-shaped frame on a first end and coupled to the bearing pad on a second end to buffer movement of the first roller.

6. The fuser mechanism of claim 1, wherein the housing further comprises at least one support arm for supporting the adjusting device.

7. The fuser mechanism of claim 6, wherein the support arm further comprises a track to guide the movement of the adjusting device.

8. The fuser mechanism of claim 2, wherein the engagement part further comprises a rack to engage with the gear.

9. An electrophotographic apparatus, comprising:

a housing;

a first roller rotatably and movably disposed inside the housing;

a second roller rotatably disposed inside the housing and separated from the first roller with a gap for a paper passing through;

a U-shaped frame;

a groove disposed on the U-shaped frame for guiding the movement of the first roller;

a bearing pad for touching one side of the first roller;

a resilient unit coupled to the U-shaped frame on a first end and coupled to the bearing pad on a second end to buffer movement of the first roller;

at least an elastic unit disposed on one end of the first roller to provide a force pushing the first roller toward the second roller along a first direction; and at least an adjusting device movably disposed on one side of the first roller, the adjusting device having a contact part, the contact part having a sloping surface touching the first roller;

wherein as the adjusting device moves along a second direction substantially perpendicular to the first direction, the sloping surface touching against the first roller to provide a force pushing the first roller to move opposite to the first direction, which causes value of the gap to be changed.

10. The electrophotographic apparatus of claim 9, further comprising an image formation unit for forming a toner on a paper, and at least one of the first roller and the second roller comprising a heater to fuse the toner on the paper.

11. The electrophotographic apparatus of claim 9, further comprising a driving device, and wherein the adjusting device further includes an engagement part, the driving device comprising:

an axle rotatably disposed inside the housing; and at least a gear disposed on one end of the axle and engaging with engagement part of adjusting device;

wherein engagement between the gear and the engagement part enables the driving device to drive the adjusting device to move during rotation of the axle.

12. The electrophotographic apparatus of claim 11, wherein the gear selectively rotates clockwise and counterclockwise.

13. The electrophotographic apparatus of claim 9, wherein the housing further comprises at least one support arm for supporting the adjusting device.

14. The electrophotographic apparatus of claim 13, wherein the support arm further comprises a track to guide movement of the adjusting device.

15. The electrophotographic apparatus of claim 9, wherein the engagement part further comprises a rack to engage with the gear.

16. The electrophotographic apparatus of claim 9, wherein the driving device further comprises a motor coupled to one end of the axle for rotating the axle.

* * * * *